US005255460A

United States Patent [19]

Lee

[11] Patent Number: 5,255,460

[45] Date of Patent: Oct. 26, 1993

[54] DIAGRAMMATIC INDICATOR PLATE ASSEMBLY

[76] Inventor: Vincent K. W. Lee, No. 44, Lane 458, Sheh Chung Street, Taipei, Taiwan

[21] Appl. No.: 929,135

[22] Filed: Aug. 13, 1992

[51] Int. Cl.[5] ..... G09F 19/00

[52] U.S. Cl. ..... 40/409

[58] Field of Search ..... 40/406, 410, 407, 409; 446/166, 267; 273/457, 115

[56] References Cited

U.S. PATENT DOCUMENTS

| | | | |
|---|---|---|---|
| 690,852 | 1/1902 | Gordon | 40/409 |
| 3,564,740 | 2/1971 | Calfee | 40/406 |
| 4,885,192 | 12/1989 | Tabar | 40/406 |
| 5,092,064 | 3/1992 | Lee | 40/406 |

*Primary Examiner*—James R. Brittain

*Assistant Examiner*—Cassandra Hope Davis

*Attorney, Agent, or Firm*—Bacon & Thomas

[57] ABSTRACT

A diagrammatic indicator assembly includes a hollow, transparent housing which is substantially Z-shaped in side view with upper and lower terminal portions interconnected by an angled central portion. Each of the terminal portions define reservoirs adapted to carry a sandy medium stored within the housing. An inclined plate is mounted within the housing and includes opposing sides provided with a plurality of holes for retaining some of the sandy medium as it flows thereover. The housing can be orientated in a first upright position wherein the sandy medium flows over and is retained in the holes on one side of the plate and an inverted, upright position wherein the sandy medium flows over and is retained in the holes on the other side of the plate.

3 Claims, 5 Drawing Sheets

DIAGRAMMATIC INDICATOR PLATE ASSEMBLY

BACKGROUND OF THE INVENTION

The present invention relates to an improved structure over that in U.S. Pat. No. 5,092,064, titled Liquid-drop Model Diagrammatic Indicator Plate Structure, of which its outer case is designed into a Z-shaped body to concisely lessen the inner space for the sandy flowing element inside to flow through and present a further distinctive effect of sand patterns along with its original effect of liquid-drop patterns.

Therefore, it is to be noted that the first object of the present invention is to provide a liquid-drop model diagrammatic indicator plate structure with an improved concise structure to perform multiple effects as liquid-drop, picture indicating, and sand patterns.

Another object of the invention is to provide a liquid-drop model diagrammatic indicator plate structure which, with its Z-shaped outer case an inclined plate inside forming front and back slotted passages, enables the sandy flowing element to flow smoothly and prevents the dropping liquid from dropping without passing the sliding plate; so that the liquid-drop and sand patterns can both be presented.

SUMMARY OF THE INVENTION

The liquid-drop model diagrammatic indicator plate structure of the present invention is an improved structure of the original U.S. Pat. No. 5,092,064 titled the same name. The outer case of the present structure is improved from a cube housing to a Z-shaped housing wherein its inner space has been lessened concisely to refine the smooth flow of the sandy flowing element and the clearness of viewing the patterns made in the structure. The disclosed Z-shaped structure unites the indicating effects of the sand patterns and liquid-drop patterns and achieves a distinctive performance that surpasses the original structure.

DESCRIPTION OF THE PREFERRED EMBODIMENT

Figure 1:
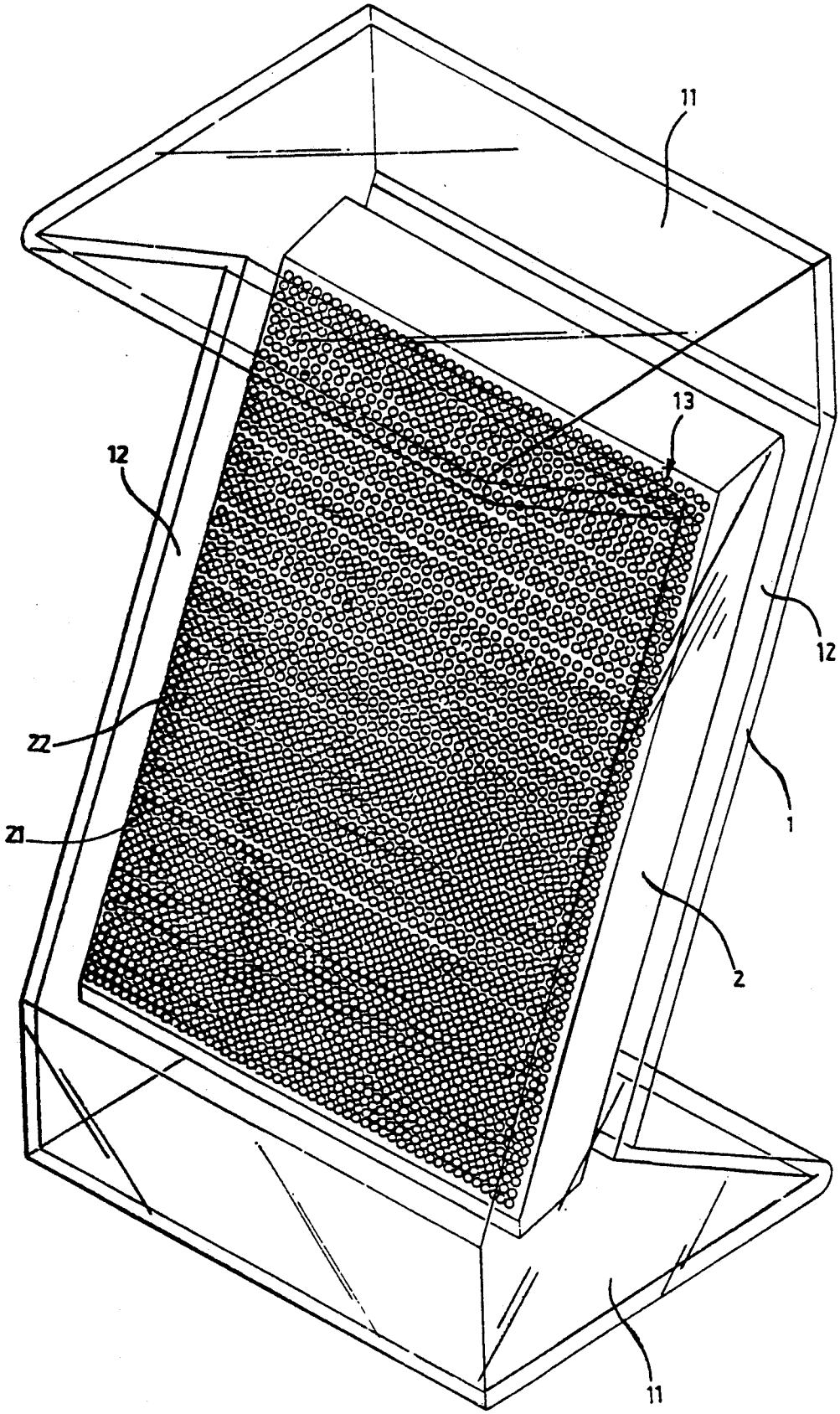
FIG. 1 is a perspective view of the present invention.
Figure 2:
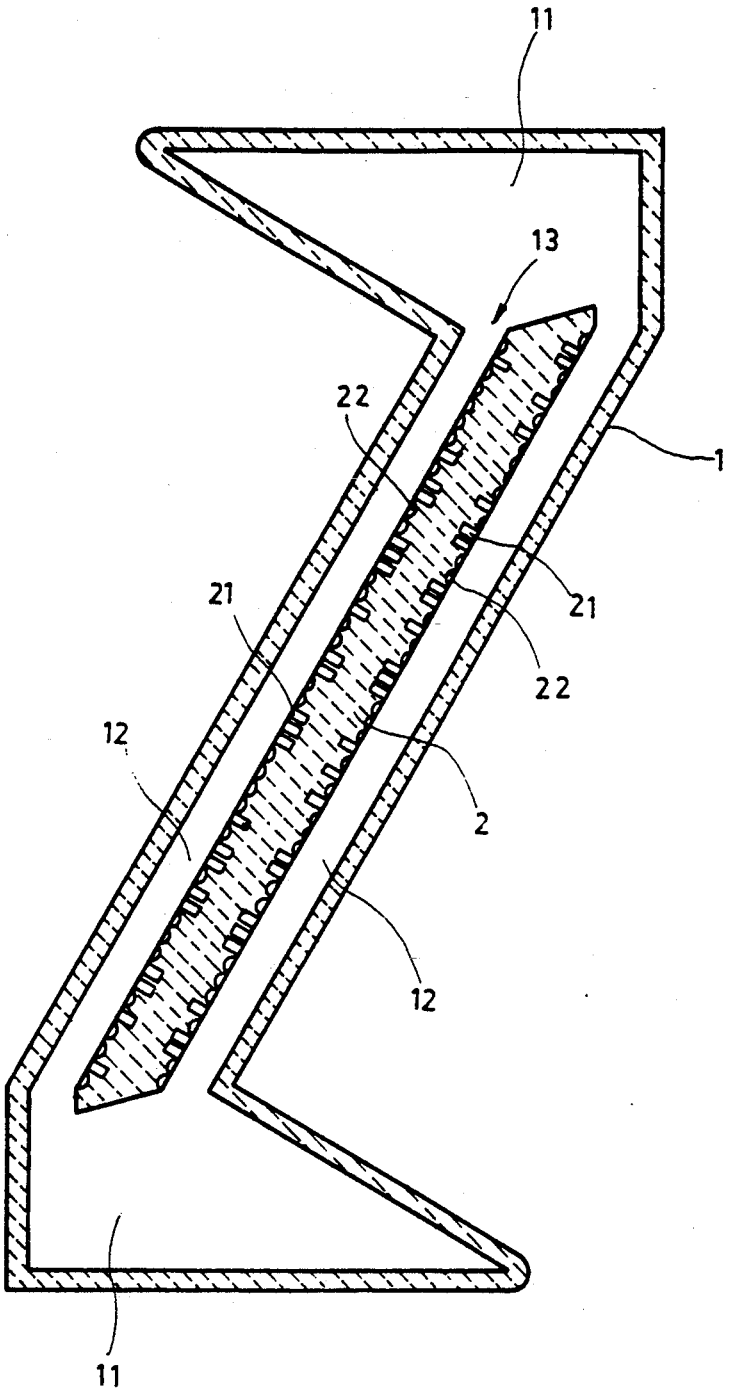
FIG. 2 is a side-sectional view of the present invention.
Figure 3:
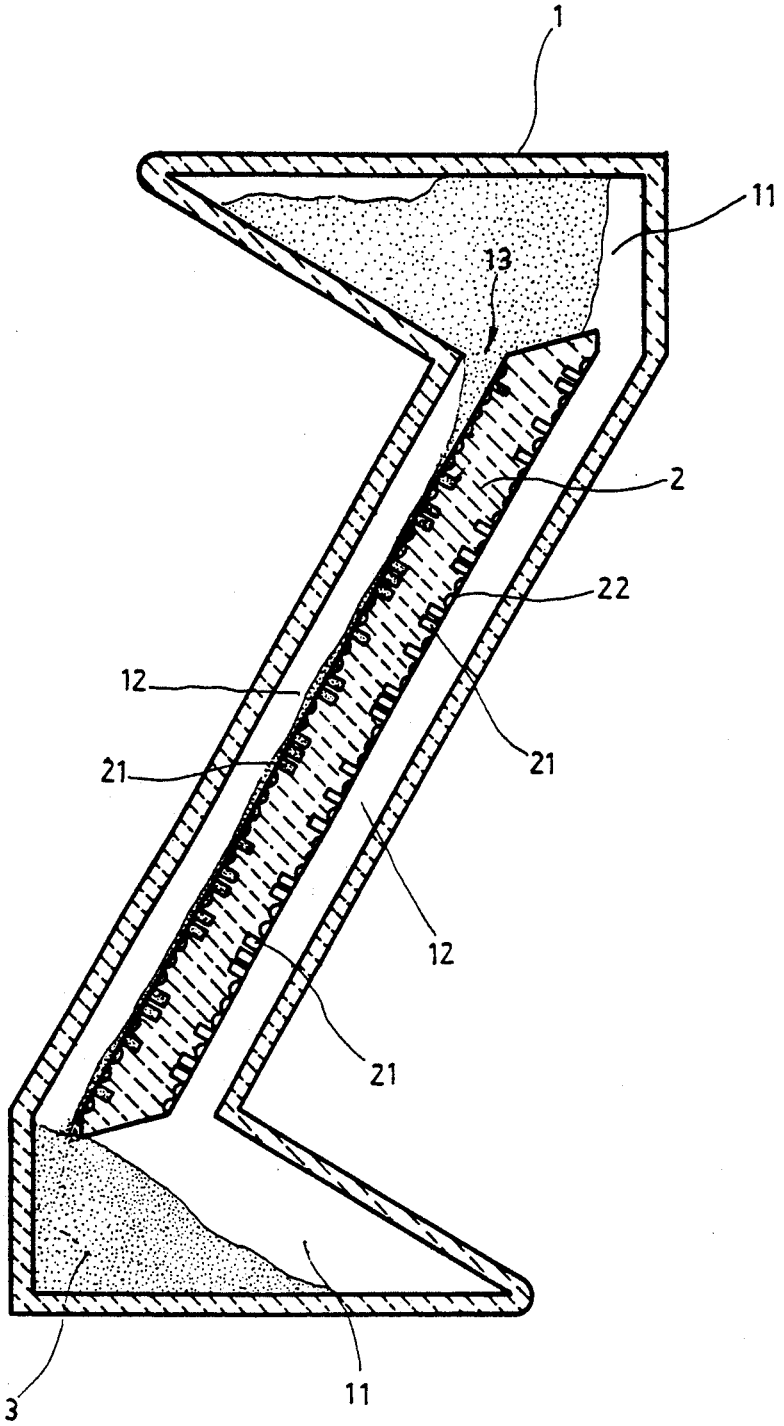
FIG. 3 is another side-sectional view showing the flow of the sandy flowing element.

The liquid-drop model diagrammatic indicator plate structure of the present invention, as shown in FIGS. 1 and 2, is an improvement over that in U.S. Pat. No. 5,092,064 which comprises a transparent Z-shaped housing (1) and a plate (2) installed inside the housing (1). The Z-shaped housing (1) is provided with two thick terminals and an inclined thin flat middle part; the thick terminals respectively form reservoirs (11) to contain a large quantity of a sandy flowing element (3), and both terminals are capable of standing to support the structure. The plate (2) is specifically designed to fit into the flat middle part of the housing (1) so that the space in the middle part, after the installation of the plate (2), can be divided and formed into a front and a back narrow (about 2 m/m) slotted passages (12) for communicating with both reservoirs (11) in the terminals. On both sides of the plate, a number of holes (21) are preset for indicating specific patterns while a number of shallow concaves (22) are also provided for disguising those pattern indicating holes (21), and the plate (2) thereby looks like it is just provided with multiple holes without any special patterns. When the housing (1) is reversed to allow all the sandy flowing element (3) originally at the bottom to be at the top, as illustrated in FIG. 3, the flowing element (3) which has a specific gravity higher than the float of the liquid will then flows downwards from the reservoir through an exit groove (13) to the slotted passage (12). Although there will be a convection between the liquid and the sandy element (3) at the moment of reversing the housing, however, the sandy element (3) will flow along the front passage because of the narrow space (about 2 m/m) of the passage. In the process of the flow, the sandy element (3) will slide down through these shallow concaves (22) smoothly while being retained a certain amount in those holes (21), and thereby the preset pattern will be revealed gradually. The rest of the large quantity of the sandy element (3) which keeps flowing downwards will be amassed at the bottom and forms a mimic scene of the desert.

Figure 4:
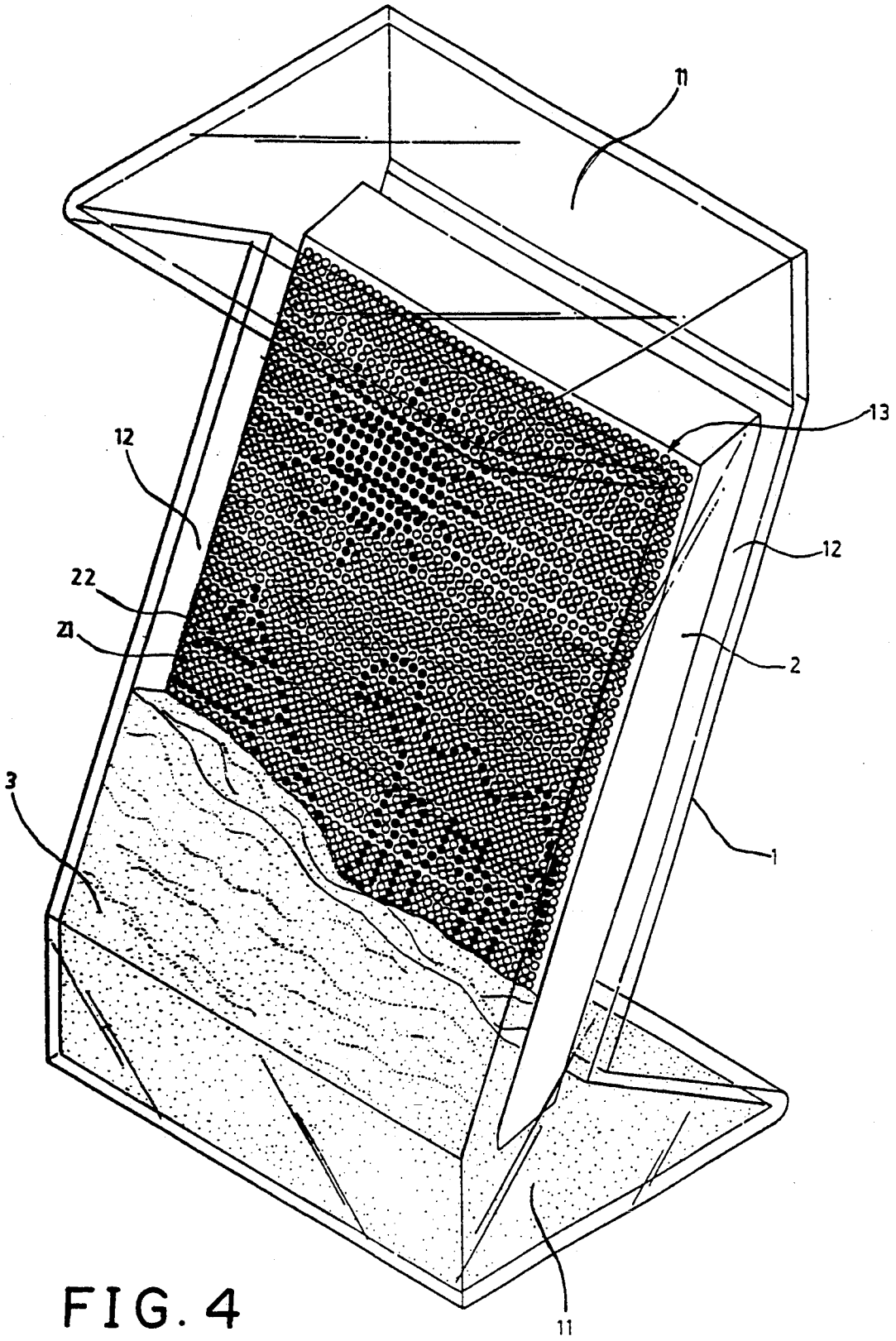
FIG. 4 is a perspective view showing the front of the preferred embodiment.
Figure 5:
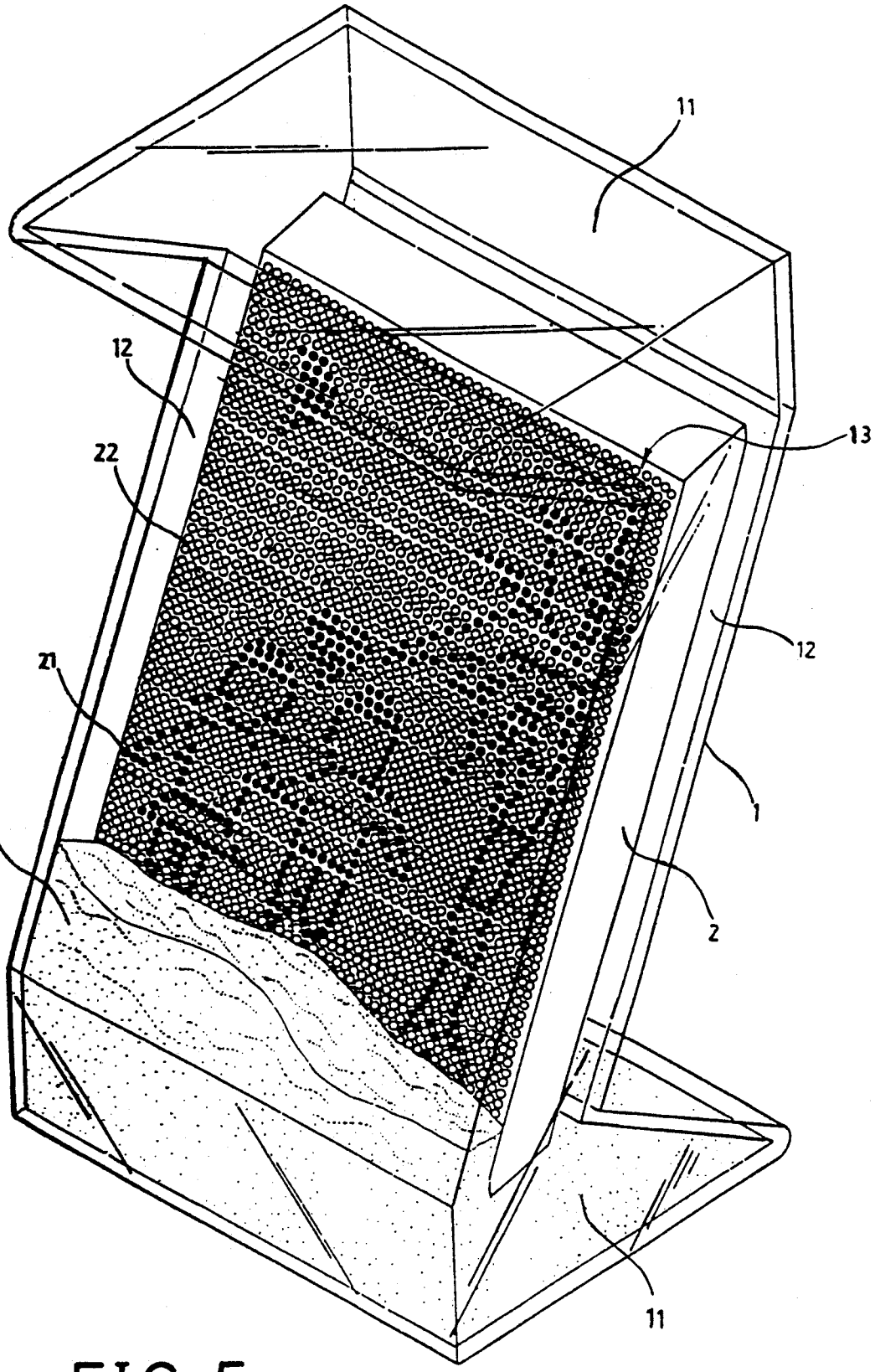
FIG. 5 is another perspective view showing the back of the preferred embodiment (after the reversion of the structure).

FIG. 4 illustrates an embodiment which the plate (2) is preset with a desert scenery to go with the sandy pattern at the bottom for presenting an outstanding life-like desert scene. As the housing (1) is reversed again, the sandy element (3) been carried accordingly will again flow downwards through the passage (12) on the inclined surface of the plate (2) on the other side and likewise be retained in the holes (21) to reveal another preset pattern, for example the tropical beach scene as shown in FIG. 5, going with an alternative sand pattern formed at the bottom.

As afore-mentioned features, it is realized that the present invention which combines the liquid-drop effect and the sand pattern effect is novel and distinctive for decoration and surpasses any prior arts in this field.

I claim:

1. A diagrammatic indicator assembly comprising:

a hollow, transparent housing which is substantially Z-shaped in side view with upper and lower terminal portions interconnected by an angled central portion, said angled central portion being defined by spaced, substantially parallel wall members, said terminal portion defining a first and second reservoirs within said housing and being adapted to support said housing in a first upright position and an inverted, upright position respectively;

a plate mounted within said housing, said plate having first and second opposed side surfaces that extend substantially parallel to said angled central portion, said plate being spaced from each of said wall members by a predetermined distance so as to define first and second passages located between said first and second side surfaces and said wall members respectively, each of said first and second passages opening into said first and second reservoirs, each of said first and second side surfaces including a plurality of holes therein; and a sandy medium retained within said housing, said sandy medium being adapted to flow from said first reservoir, within said first passage and over said first side surface, toward the second reservoir while retaining at least a portion of the sandy medium in the holes provided in said first side surface when said housing is moved from said inverted upright position to said first upright position and to flow from said second reservoir, within the second passage and over said second side surface, toward said first reservoir while retaining at least a portion of the sandy medium in the holes provided in said second side surface when said housing is moved from said first upright position to said inverted, upright position.

2. The diagrammatic indicator assembly of claim 1, further including a liquid medium retained within said housing.

3. The diagrammatic indicator assembly of claim 2, wherein, in addition to said holes, each of said first and second side surfaces include a plurality of shallow concavities.

* * * * *